US005996308A

United States Patent [19]

Nakamura

[11] Patent Number: 5,996,308

[45] Date of Patent: Dec. 7, 1999

[54] ARTICLE PROCESSING APPARATUS

[75] Inventor: Ryohei Nakamura, Ishikawa-Ken, Japan

[73] Assignee: Shibuya Kogyo Co., Ltd., Ishikawa-Ken, Japan

[21] Appl. No.: 09/066,631

[22] Filed: Apr. 24, 1998

[30] Foreign Application Priority Data

May 30, 1997 [JP] Japan ..... 9-157871
May 30, 1997 [JP] Japan ..... 9-157872

[51] Int. Cl.[6] ..... B65B 1/04; B65B 7/28; B65B 55/00

[52] U.S. Cl. ..... 53/167; 53/282; 53/251; 53/284.5; 53/306; 53/367

[58] Field of Search ..... 53/167, 247, 251, 53/282, 287, 306, 310, 312, 329, 367, 539, 284.5; 901/7

[56] References Cited

U.S. PATENT DOCUMENTS

| | | | |
|---|---|---|---|
| 2,988,237 | 6/1961 | Devol | 901/7 |
| 3,185,328 | 5/1965 | Dardaine | 53/539 |
| 3,517,831 | 6/1970 | Hahn | 53/539 |
| 3,601,951 | 8/1971 | Bargel | 53/247 |
| 3,665,148 | 5/1972 | Yasenchak | 901/7 |
| 3,783,587 | 1/1974 | Kurtenbach | 53/247 |
| 4,205,502 | 6/1980 | Ahlers | 53/367 |
| 4,630,428 | 12/1986 | Lesch | 53/251 |
| 4,789,417 | 12/1988 | Komatsu | 901/7 |
| 5,048,259 | 9/1991 | Cox | 53/329 |

FOREIGN PATENT DOCUMENTS

| | | |
|---|---|---|
| 4-59233 | 9/1992 | Japan . |
| 6-76102 | 9/1994 | Japan . |
| 7-215400 | 8/1995 | Japan . |
| 7-228354 | 8/1995 | Japan . |

*Primary Examiner*—John Sipos
*Attorney, Agent, or Firm*—Flynn, Thiel, Boutell & Tanis, P.C.

[57] ABSTRACT

The invention relates to an article processing apparatus which is preferred for use in a capper which attaches a cap to a vessel. The apparatus includes a processing head, which is provided with four capping mechanisms. Each capping mechanisms on the processing head takes hold of a cap on feeder means. The processing head is then translated to a position over a conveyor and moves in tracking relationship with four vessels which are being conveyed by the conveyor to attach each cap carried by the capping mechanism to associated underlying vessel. The attachment of a cap to a vessel while the processing head moves in tracking relationship with vessels on the conveyor provides an article processing apparatus which has its processing capability enhanced as compared with the prior art.

16 Claims, 12 Drawing Sheets

ARTICLE PROCESSING APPARATUS

FIELD OF THE INVENTION

The invention relates to an article processing apparatus, and more particularly, to such apparatus which is preferred for use with a capper which attaches a cap to a vessel, for example.

DESCRIPTION OF THE PRIOR ART

An arrangement which attaches a cap to a body of lipstick, for example, is known in the art, as exemplified by Japanese Laid-Open Patent application No. 215,400/1995. A capper which attaches a cap to a vessel on a conveyor is disclosed in Japanese Patent Publication No. 76,102/1994. A conventional arrangement of the kind described is provided with a processing head which applies a required processing to an article, and the attachment of a cap can be completed through a movement of the processing head.

However, in the known arrangement in the art, the capping operation is performed while maintaining the article at rest at a given position, and this resulted in a disadvantage of a low throughput in comparison to an arrangement which enables a capping operation while the article is on its way of conveyance.

A capping arrangement in which the capping operation takes place while a vessel is being conveyed on a conveyor is disclosed, for example, in Japanese Patent Publication No. 59,233/1992. In the disclosed arrangement, a processing head which performs a capping operation moves back and forth along the conveying path of a conveyor while being elevated up and down on the conveyor. In other words, the processing head travels only above the conveyance path of the conveyor, and accordingly, there has been a need that a supply of a cap to the processing head be effected in a region below the head and above the carrying surface of the conveyor. This resulted in a disadvantage of the arrangement of the cited Japanese Patent Publication No. 59,233/1992 that it requires a complicated feeder to feed a cap to the processing head.

SUMMARY OF THE INVENTION

In view of the foregoing, the present invention provides an article processing apparatus comprising a conveyance mechanism for conveying an article continuously in a horizontal direction, and processing means movable between a first processing position above the conveyance mechanism and a second processing position offset from the first processing position and elevatable while tracking an article being conveyed by the conveyance mechanism to apply a necessary processing operation to the article, the processing means including a support member which is movable in a direction orthogonal to the direction of conveyance by the conveyance mechanism and also elevatable, and a processing head mounted on the support member and movable along the direction of conveyance by the conveyance mechanism.

With the described arrangement, the processing means can apply a necessary processing operation to an article while moving in tracking relationship with the article which is being conveyed by the conveyance mechanism. In this manner, there can be provided an article processing apparatus which excels the prior art in the processing capability, while suppressing a complicatedness in construction.

Above and other objects, features and advantages of the invention will become apparent from the following description of an embodiment thereof with reference to the drawings.

DETAILED DESCRIPTION OF THE EMBODIMENTS

Figure 1:
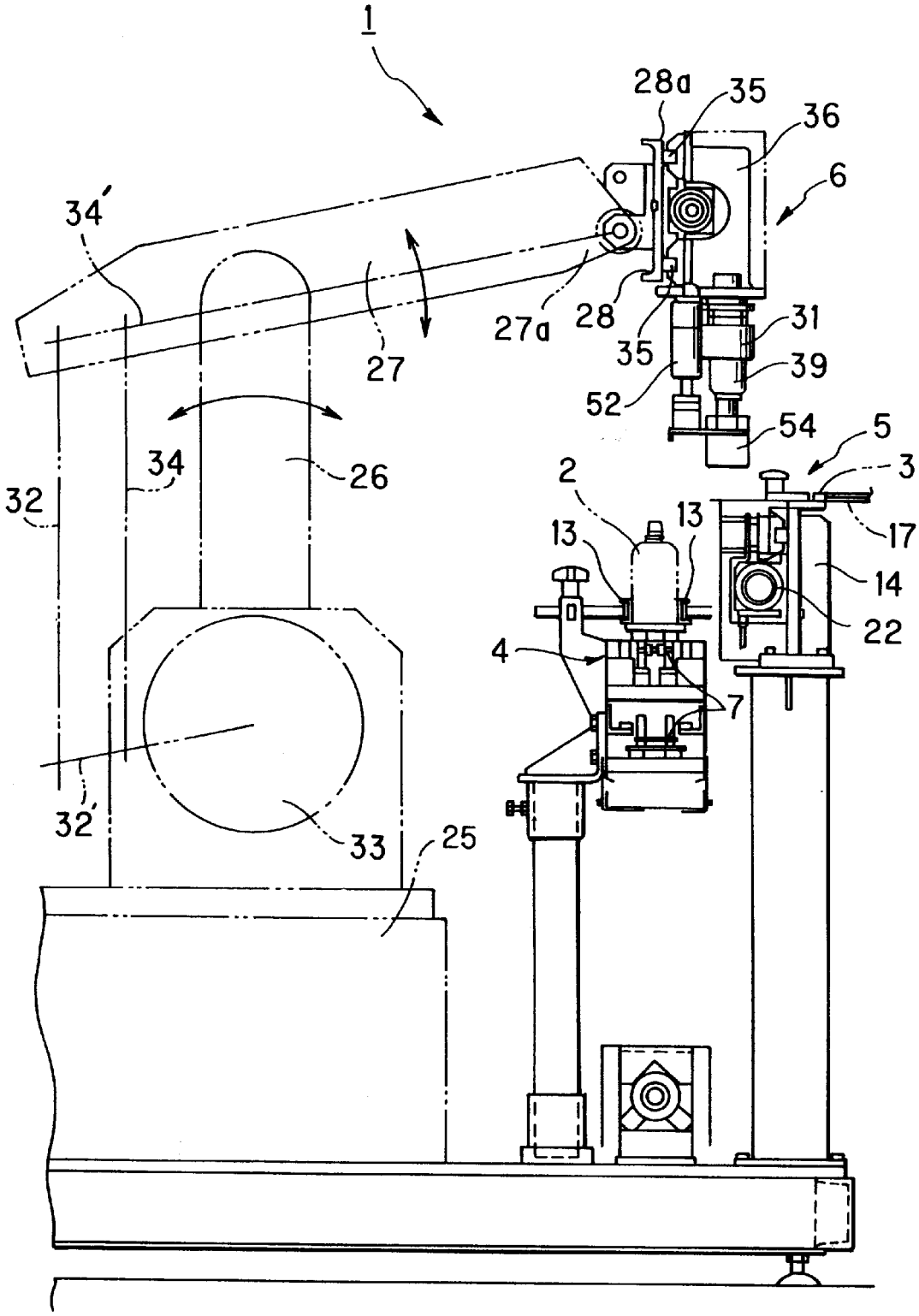
FIG. 1 is a front view of one embodiment of the invention.
Figure 2:
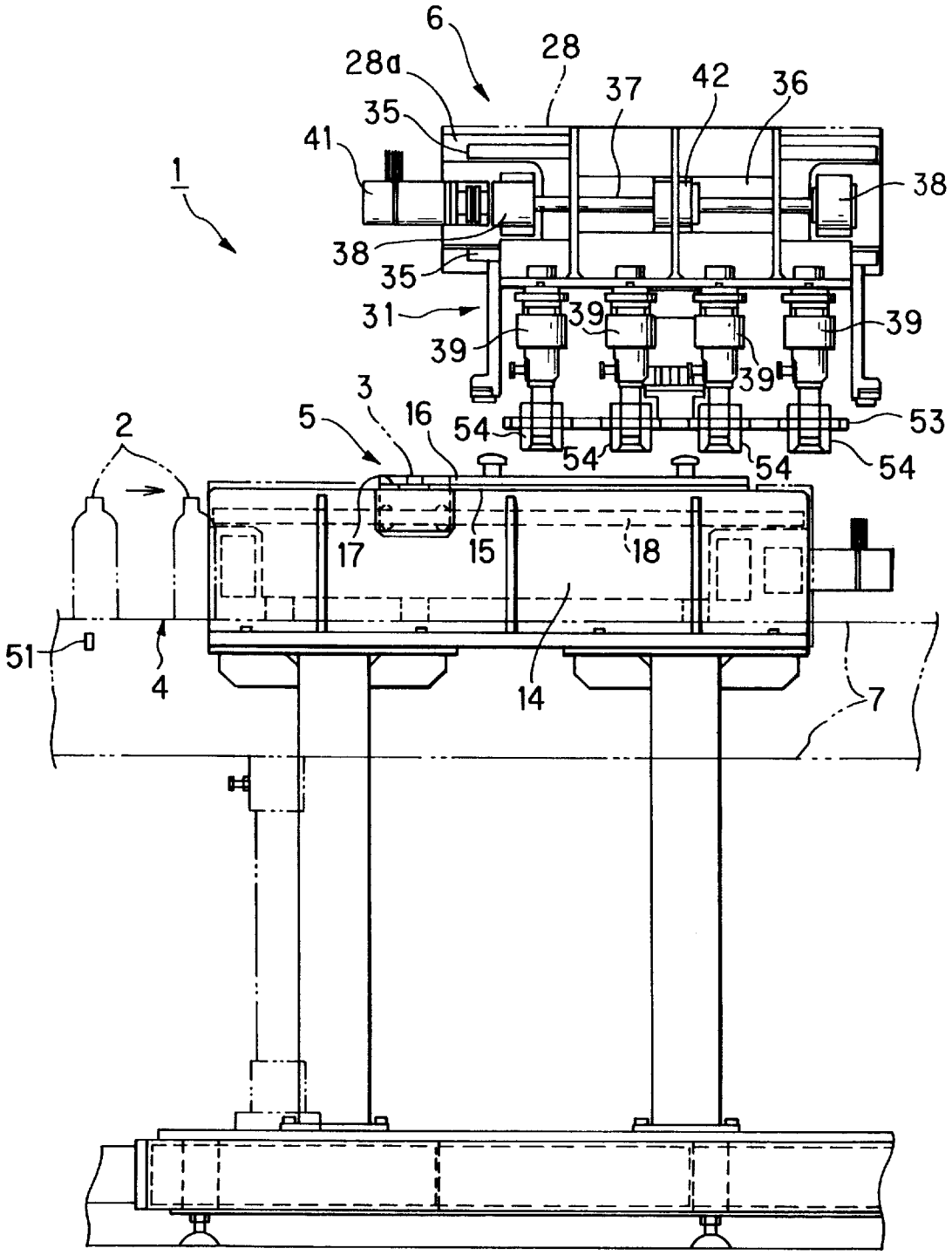
FIG. 2 is a right-hand side elevation of the embodiment shown in FIG. 1.

Referring to the drawings, several embodiments of the invention will now be described. Referring to FIGS. 1 and 2, there is shown a capping apparatus 1 which applies a cap 3 to a vessel 2. The capping apparatus 1 comprises a conveyor 4 which continuously conveys the vessels 2 in a direction indicated by an arrow, feeder means 5 disposed to run parallel to the conveyor 4 for feeding the cap 3 at a given location, and a robot 6 disposed on the other side of the conveyor 4 from the feeder means 5 and operable to attach the cap 3 to the upper end of the vessel 2.

Figure 3:
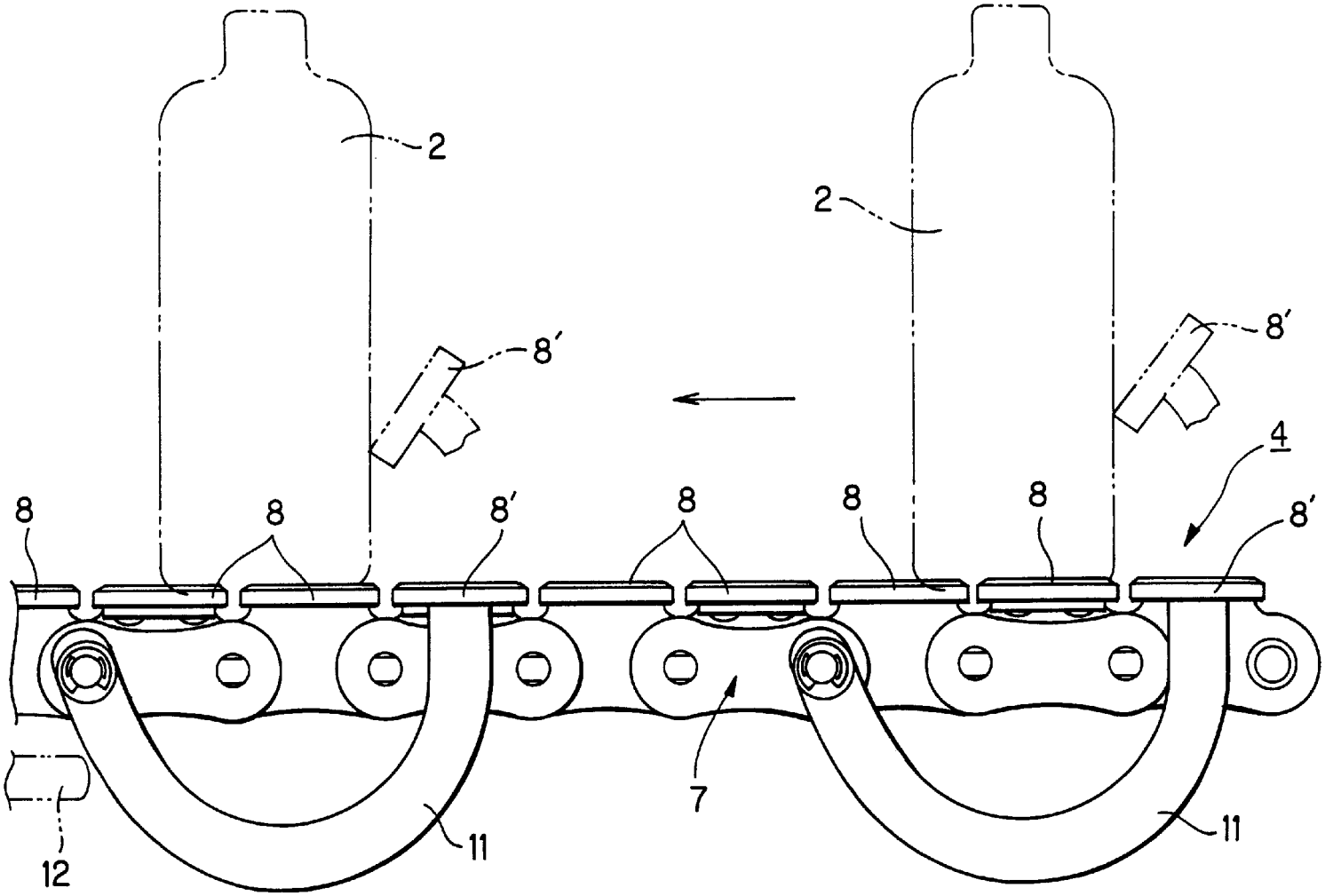
FIG. 3 is a side elevation of a pertinent portion of a conveyor shown in FIG. 1.

As shown in FIG. 3, the conveyor 4 comprises a chain 7 which runs at a given speed in continuous circulation, and a multiplicity of plates 8, 8' which are disposed on an upper surface of the chain 7 in orthogonal direction thereto. As the chain 7 runs, a vessel 2 placed on each plate 8 moves in a horizontal plane. Every fifth plate 8' is connected to one end of each of a pair of left and right rocking members 11 so as to be placed on the upper surface of the chain 7 by gravity. The pair of rocking members 11 are arcuate in configuration, and their other ends are rockably mounted at a given position lengthwise of the chain 7. A cam member 12 extends horizontally at an elevation lower than the chain 7 over a given lengthwise region of the chain 7. In this manner, as the chain 7 runs, the pair of left and right rocking members 11 engage the cam member 12, whereupon the rocking members 11 are rocked upward, thus projecting their connected plate 8' to a position indicated by phantom lines. The projected plate 8' causes the vessel 2 to be slightly displaced downstream in the direction of conveyance, with the projected plate 8' supporting the outer periphery of vessel 2 which is located downstream as viewed in the direction of conveyance.

As shown in FIG. 1, a pair of left and right guide members 13 extend along the direction of the conveyance by the conveyor 4 at a location adjacent to, but above conveyor 4 so as to support the both lateral sides of the vessel 2. In this manner, the vessels 2 on the conveyor 4 have their lateral sides, as viewed in the direction of movement, supported by the guide members 13 while the rear side as viewed in the direction of movement is supported by the respective plate 8' so as to be conveyed while maintaining a given spacing between adjacent vessels 2 which follow one after another. It is to be understood that the construction of the described conveyor 4 is known in the art.

Feeder means 5

Figure 4:
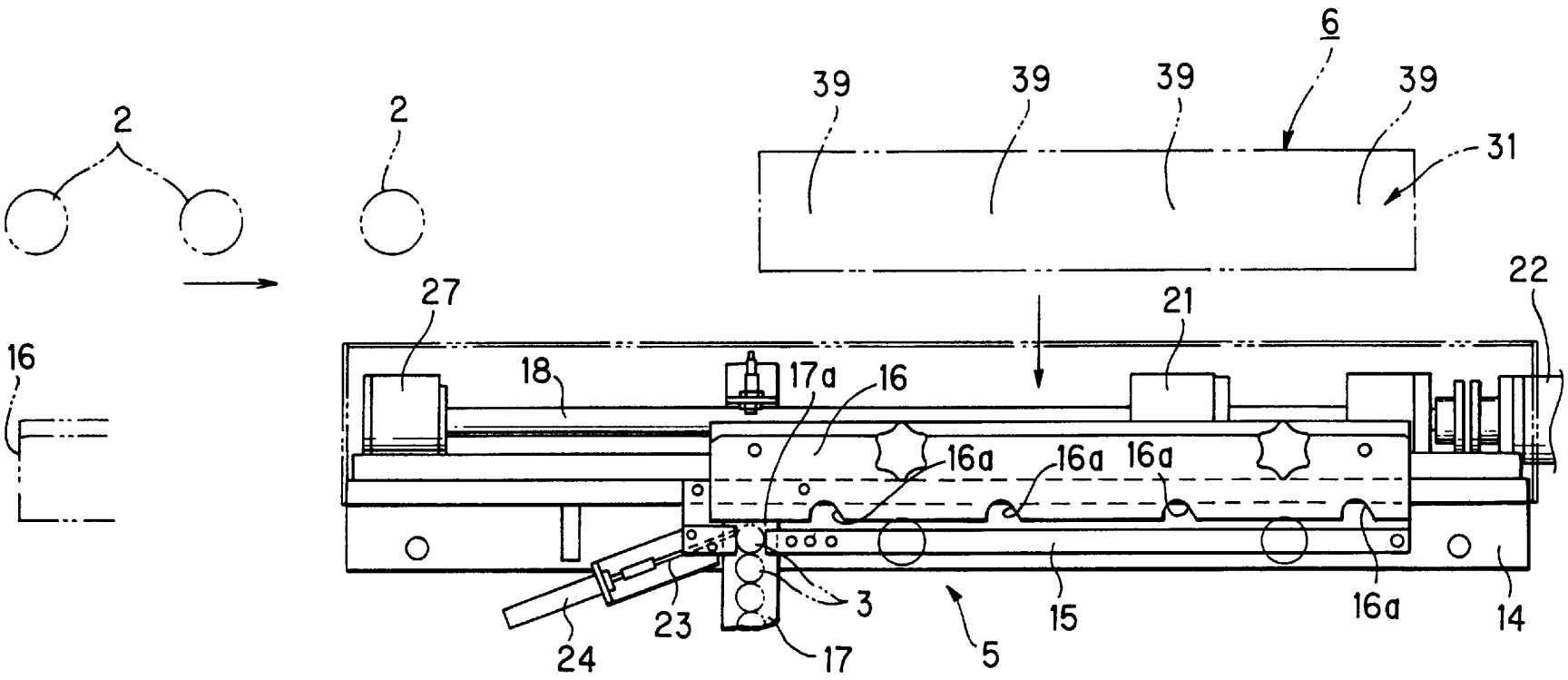
FIG. 4 is a plan view of a pertinent portion shown in FIG. 1.

As shown to an enlarged scale in FIG. 4, feeder means 5 comprises a horizontal support member 14, a guide member 15 and a picker 16 disposed on the upper surface of the support member 14 and extending parallel to the direction of conveyance of the conveyor 4, and a feeder chute 17 disposed at the upstream end of the guide member 15 and extending in a direction orthogonal thereto.

The guide member 15 is secured to the upper surface of the support member 14, but the picker 16 is arranged to maintain a given distance with respect to the guide member 15 so as to be reciprocable in a direction parallel to the direction of conveyance by the conveyor 4. A threaded shaft 18 is rotatably journalled on a lateral side of the support member 14 and is threadably engaged by a nut member 21 which is connected to the picker 16. The threaded shaft 18 is coupled to a motor 22, which may be driven for an incremental rotation in either forward or reverse direction to cause the picker 16 to reciprocate between a downstream end position shown in solid line and an upstream end position shown in phantom lines in FIG. 4.

Figure 6:
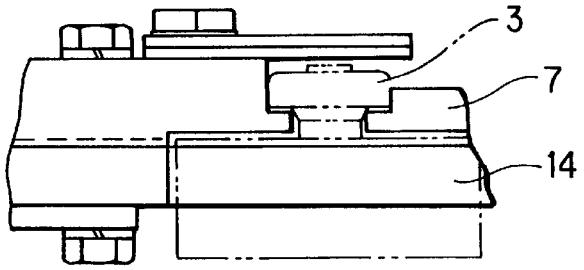
FIG. 6 is a cross section taken along the line VI—VI shown in FIG. 5.

The feeder chute 17 is driven for oscillation by a drive mechanism, not shown, whereby successive caps 3 which are held by the chute 17 are transferred toward the forward end 17*a* of the chute 17 while being held in abutment against each other. As shown in FIG. 6, the cap 3 used in the present embodiment is in a stepped columnar form, and is axially formed with a through-opening of a small diameter extending therethrough, which is not shown in the drawings. The caps 3 are held in the chute 17 so that its portion of reduced diameter is located downside while a portion of an increased diameter is disposed upside.

The forward end 17*a* of the chute 17 is located on an extension of a guide surface 15*a* of the guide member 15. On the other hand, an end face of the picker 16 which faces the guide surface 15*a* is slightly spaced from the forward end 17*a* of the chute 17 and the guide surface 15*a*, and is formed with four engaging recesses 16*a* at an equal interval.

Figure 5:
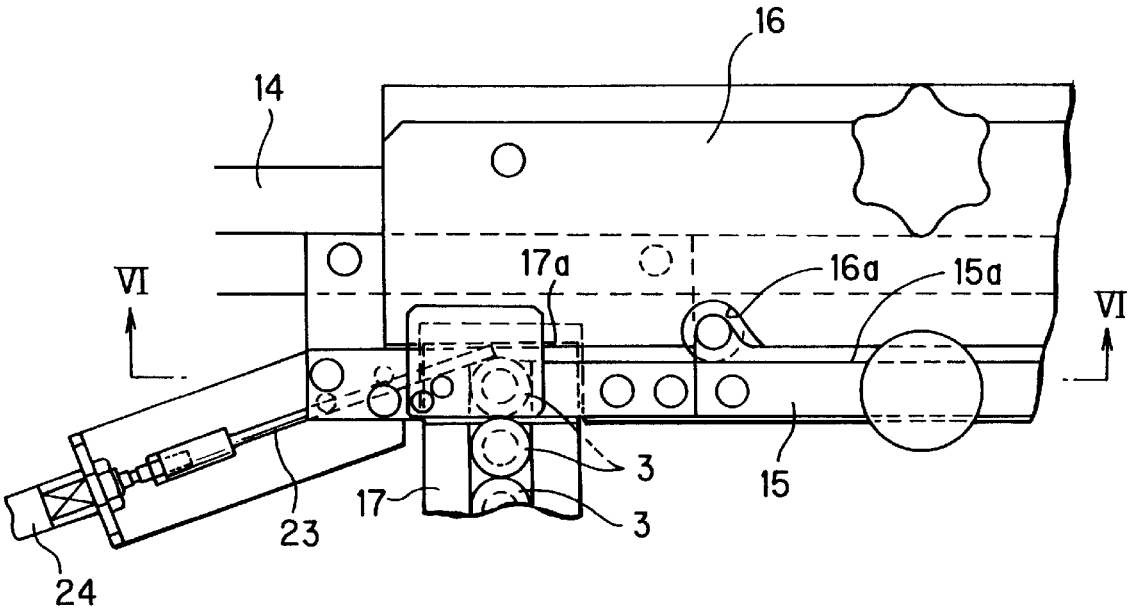
FIG. 5 is an enlarged view of the portion shown in FIG. 4.

As shown in FIGS. 4 and 5, a stop 23 which is disposed to cross the lengthwise direction of the chute 17 at an angle is located to one side of the forward end of the chute 17 so as to be capable of advancing and retracting movement. The advancing and retracting movement of the stop 23 is performed by an air cylinder 24. When the air cylinder 24 causes the stop 23 to advance to its foremost position, the forward end 17*a* of the chute 17 is closed by the stop 23, thus preventing the cap 3 from being fed from the forward end 17*a* into one of engaging recesses 16*a* in the picker 16. By contrast, when the air cylinder 24 causes the stop 23 to retract to its aftermost end, the stop 23 opens the forward end 17*a* of the chute 17, whereby one of the caps 3 can be fed from the forward end 17*a* of the chute 17 into the picker 16. The elevation of the upper surface of the support member 14 on which the caps 3 are supported is chosen to be slightly higher than the upper end of the vessel 2 on the conveyor 4.

Describing the operation of the feeder means 5, under a condition that the forward end 17*a* of the feeder chute 17 is closed by the stop 23, the picker 16 having empty engaging recesses 16*a* is initially moved from the downstream end position shown in solid line in FIG. 4 to the upstream end position shown in phantom lines. By this time, the forward end 17*a* of the feeder 17 is held closed by the stop 13, and accordingly if successive engaging recesses 16*a* pass by the location of the forward end 17*a* of the feeder chute 17, no cap 3 can be fed into any engaging recess 16*a* of the picker 16. Subsequently, the stop 13 is caused to retract, whereupon the forward end 17*a* of the feeder chute 17 is opened, followed by the movement of the picker 16 from its upstream end position shown in phantom lines to the original downstream end position shown in solid line where it comes to a rest. In the course of such movement, as each engaging recess 16*a* of the picker 16 passes by the forward end 17*a* of the feeder chute 17, a cap 13 which is located in the forward end 17*a* of the feeder chute 17 is successively engaged with the recess to be taken out of the feeder chute. The lateral side of the cap 3 which is engaged by an engaging recess 16*a* is supported by the guide surface 15*a* of the guide member 15.

When the picker 16 holding the caps 3 in its four engaging recesses 16*a* reaches and comes to a rest at its downstream end position, the caps 3 in the engaging recesses 16*a* are engaged by the robot 6 to be taken out of the associated engaging recesses 16*a* to be mounted successively on four vessels 2 which are being conveyed by the conveyor 4.

Robot 6

Figure 7:
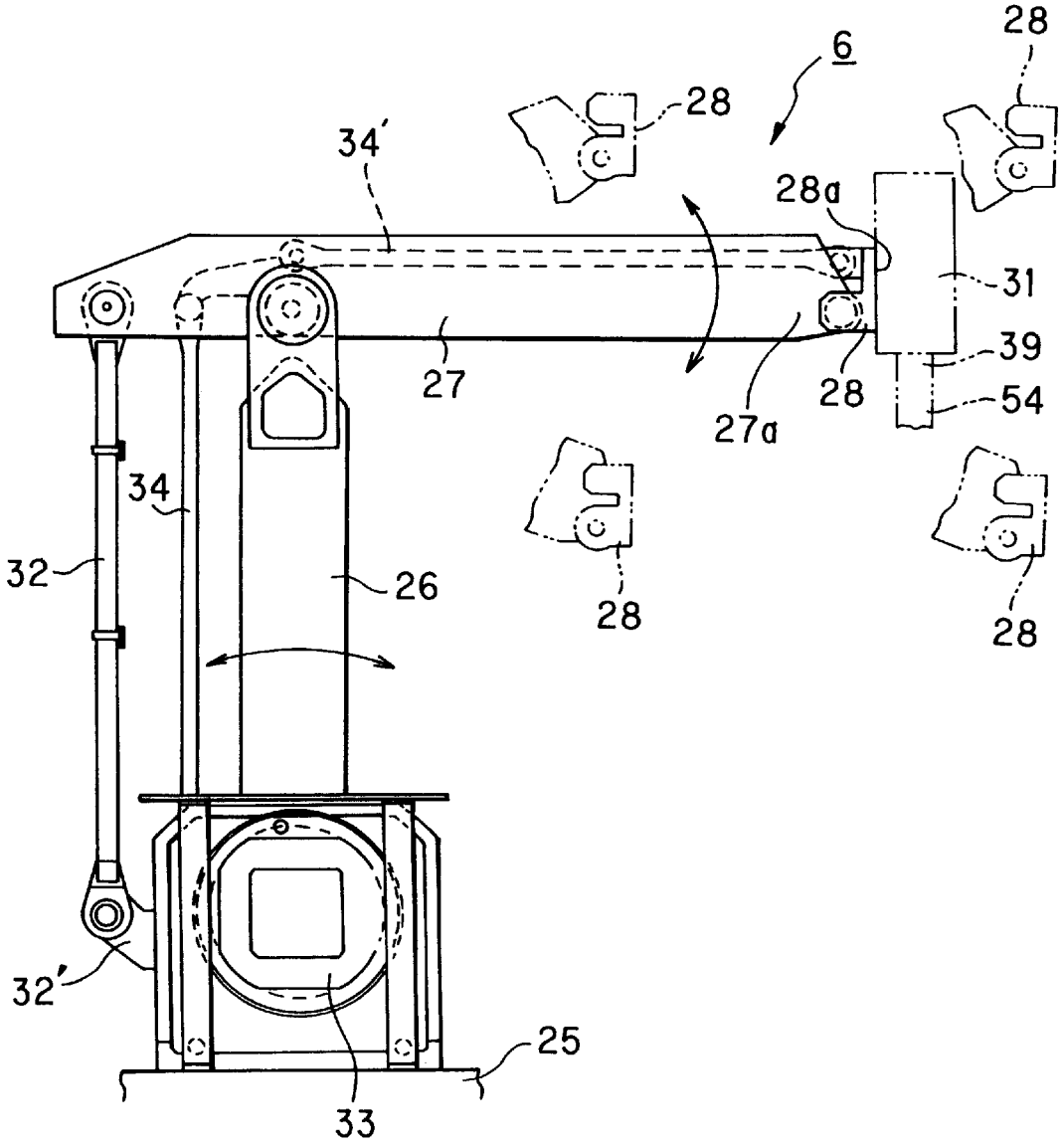
FIG. 7 is a front view of an essential portion of a robot 6 shown in FIG. 1.

Referring to FIGS. 1 and 7, the robot 6 comprises a first rocking member 26 rockably mounted on a support frame 25, a second rocking member 27 which is rockably mounted, at a given lengthwise location thereof, on the upper end of the first rocking member 26, a third rocking member 28 rockably mounted on the free end 27*a* of the second rocking member 27, and a processing head 31 mounted on the third rocking member 28.

The first rocking member 26 has its bottom end journalled in the support frame 25 so as to be rockable in a direction orthogonal to the direction of conveyance by the conveyor 4. The first rocking member 26 is coupled to a motor, not shown. The second rocking member 27 and the third member 28 are also rockable in a direction orthogonal to the conveyor 4.

The second rocking member 27 is coupled through a plurality of links 32, 32' with a motor 33, and the third rocking member 28 is coupled through separate links 34, 34' with the motor 33.

As a consequence, the individual rocking members 26, 27, 28 can be rocked by causing a rotation of the motor 33 and the motor, not shown, to which the first rocking member 26 is coupled through a given angle in either forward or reverse direction, thus enabling the processing head 31 mounted on the third rocking member 28 to move in a direction orthogonal to the conveyor 4 between a position above the feeder means 5 and a position on the conveyor 4 and to elevate it at positions over the feeder means 5 and the conveyor 4. As shown in FIG. 7, the third rocking member 28 which is moved and the processing head 31 which is mounted thereon are always maintained in a vertical plane without tilting therefrom.

A technique of moving the processing head 31 while maintaining it in a vertical plane by the use of the rocking members 26, 27, 28 and the plurality of links 32, 32', 34, 34' is disclosed, for example, in Japanese Laid-Open Patent Application No. 228,354/1995, and accordingly, a detailed description of an interconnecting structure between the rocking members 26, 27, 28 and the plurality of links 32, 32', 34, 34' will be omitted.

Capping mechanism 39

Referring to FIGS. 1, 2, 8 and 9, the third rocking member 28 includes a flat end face 28*a* which is maintained in a vertical plane and which is supported so as to be parallel to the direction of conveyance of the conveyor 4. A pair of guide rails 35 are secured to the end face 28*a* at an upper and a lower position thereon so as to extend horizontally. A movable frame 36 has guide grooves 36*a* which are slidably engaged with the guide rails 35. Along its lengthwise direction, the movable frame 36 carries on its bottom surface four capping mechanisms 39 at an equal pitch as viewed in the direction of conveyance by the conveyor 4.

A threaded shaft 37 is rotatably journalled on the end face 28*a* of the third rocking member 28 by a pair of bearing members 38 to extend parallel to the guide rails 35, and is coupled to a motor 41 which is mounted on the end face 28*a*. A nut member 42 is connected to the movable frame 36 and is threadably engaged with the threaded shaft 31.

Accordingly, when the motor 41 is driven for rotation through a given angle either forwardly or reversely, the movable frame 36 and the four capping mechanisms 39 mounted thereon can be driven back and forth along the guide rails 35. The number of revolutions of the motor 41 is adjusted so that the movable frame 36 and the capping mechanisms 39 move along the guide rails 35 with a speed which is equal to the speed with which the vessels 2 are conveyed by the conveyor 4.

Construction of capping mechanisms 39

All of the capping mechanisms 39 mounted on the movable frame 36 are constructed in an identical manner, and accordingly, the construction of single capping mechanism 39 will be described with reference to FIGS. 8 to 10. As shown, the capping mechanism 39 comprises a pipe 43 fitted into the movable frame 36 while maintaining a vertical orientation, and a stepped tubular capping member 44 having an upper portion, the outer periphery of which is slidably fitted into the pipe 43. A stop ring 45 is mounted around the pipe 43, and a coiled spring 46 is disposed between the stop ring 45 and a step in the capping member 44 which opposes it. In this manner, the capping member 44 is normally urged downward by its own gravity and by the resilience of the coiled spring 46. Accordingly, before the cap 3 is attached to the vessel 2, the capping member 44 is located at its lowermost position where a stop 44*a* abuts against a stop 43*a* on the pipe 43. The lower end of the capping member 44 has a diameter which is chosen to be slightly greater than the external diameter of the cap 3.

The internal spaces of the pipe 43 and the capping member 44 normally communicate with each other, and one end of a conduit 48 is connected to the upper end of the pipe 43, and the other end of the conduit 48 is connected to a source of negative pressure, not shown. Accordingly, the negative pressure is normally introduced into the pipe 43 and the capping member 44, and the negative pressure is normally exerted upon the lower end of the capping member 44. The distance by which the capping members 44 of adjacent capping mechanisms 39 are spaced is chosen to be coincident with the spacing between the adjacent engaging recesses 16*a* formed in the picker 16 of the feeder means 5. In addition, the center of the robot 6, namely, the center of the third rocking member 28 as viewed in the direction of conveyance by the conveyor 4, coincides with a center position of the picker 16, as viewed in the lengthwise direction thereof, as it stays at rest at its downstream end position. Consequently, when the entire processing head 31 is moved to descend over the picker 16 which stays at rest at its downstream end position, the lower end of each capping member 44 is located immediately above each engaging recesses 16*a* in the picker 16, thus enabling the cap in each engaging recesses 16*a* to be held attracted by the lower end of each capping member 44.

Figure 9:
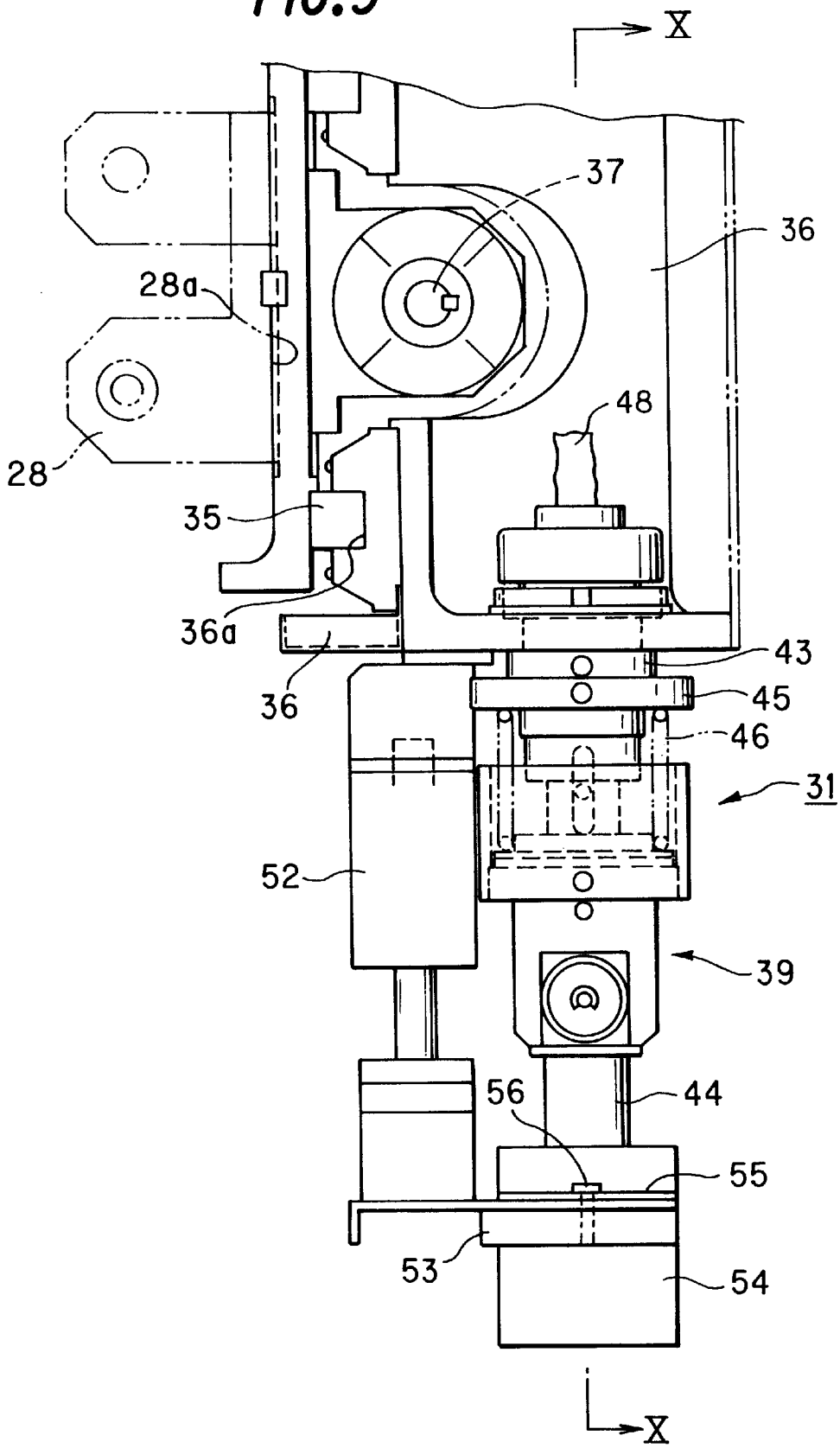
FIG. 9 is an enlarged view of a pertinent portion shown in FIG. 1.
Figure 10:
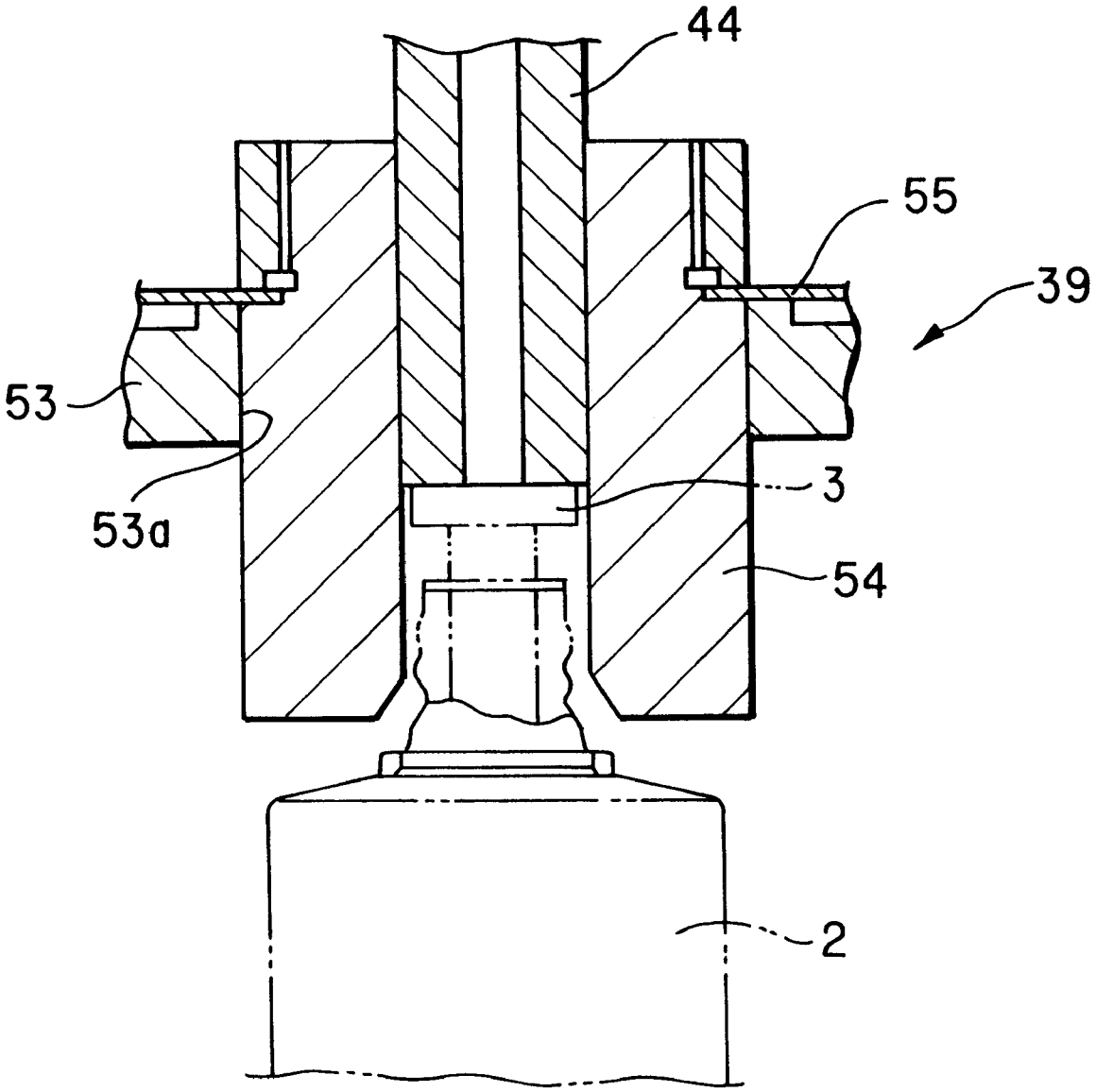
FIG. 10 is a cross section taken along the line X—X shown in FIG. 9.

A cylinder 52 is connected to and depends vertically downward from the movable frame 36 (FIG. 9). A plate-shaped member 53 is secured to the lower end of the cylinder 52 so as to assume a horizontal position. The plate-shaped member 53 is disposed below each capping mechanism 39 and is formed with a through-opening 53*a* at a location below each capping mechanism 39. A cylindrical centering member 54 slidably extends through each through-opening 53*a*. At a given location around the outer periphery, the centering member 54 is provided with a stop ring 55, which allows the centering member 54 to be supported at a given elevation by gravity where the stop ring 55 abuts against the plate-shaped member 53 by gravity.

At locations which are circumferentially displaced by 180° from each other, the stop ring 55 is formed with through-holes, into which pins 56 are inserted from above to be fitted integrally therewith. On the other hand, the plate-shaped member 53 is formed with a pair of through-holes 53*b* in alignment with the pair of pins 56 on the stop ring 55, thus allowing the through-holes 53*b* to receive the pair of pins 56 on the stop ring 55 in a slidable manner. This allows the centering member 54 to be lifted relative to the plate-shaped member 53 through a distance by which the pins 56 can be elevated within the through-holes 53*b*.

The lower end of the capping member 44 is slidably fitted into the centering member 54 from above. Toward the bottom, the inner periphery of the centering member 54 is provided as a tapered surface having a diameter which increases downward.

Figure 8:
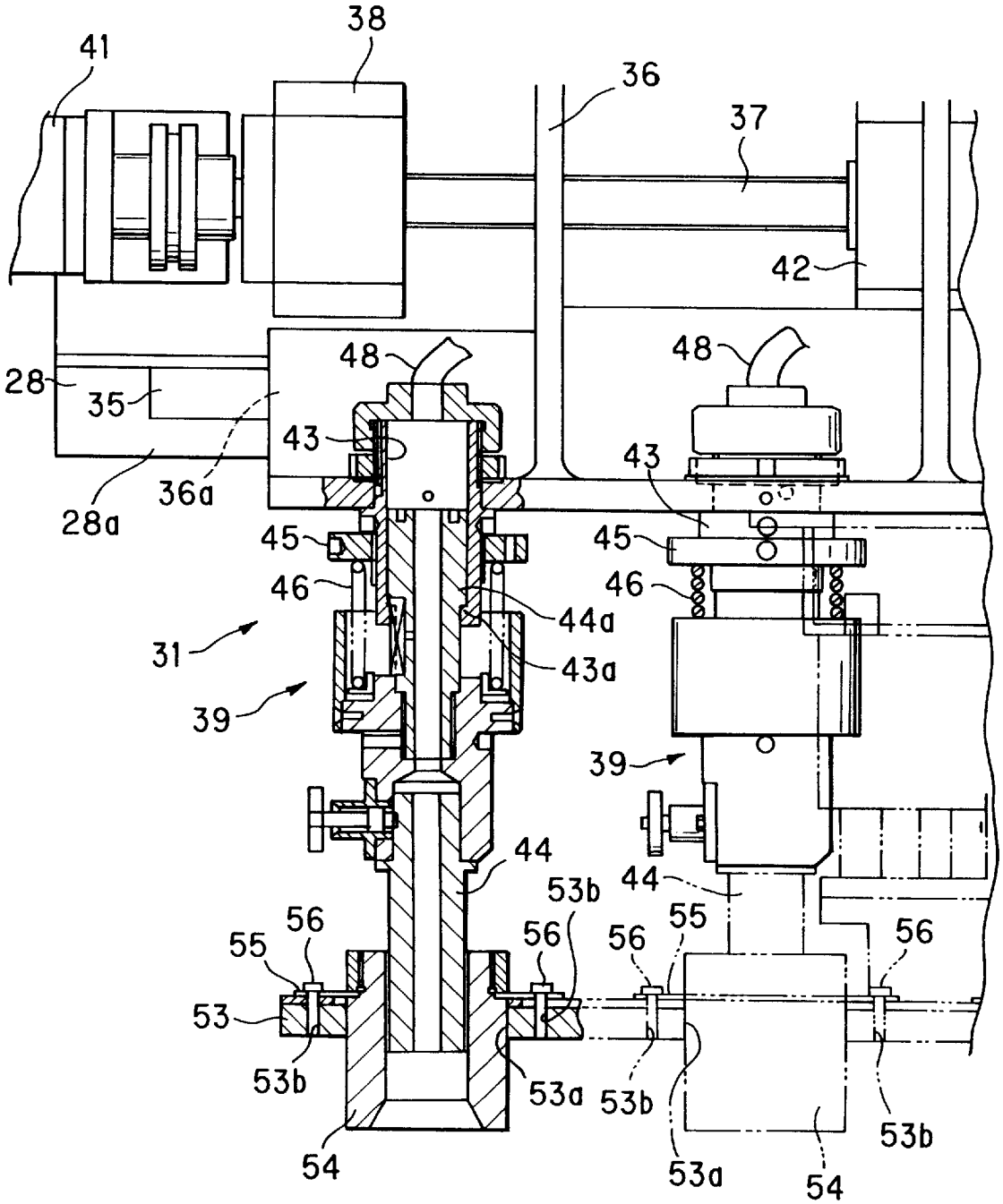
FIG. 8 is an enlarged view, partly in section, of a portion shown in FIG. 2.

As shown in FIGS. 8 and 9, when the cylinder 52 is inoperative, the plate-shaped member 53 and the centering member 54 mounted thereon assume a lowermost position with respect to the movable frame 36, and the lower end of the capping member 44 is located slightly below the axial center of the centering member 54. Under this condition, the internal space within the centering member 54 left below the lower end of the capping member 44 has an enough size to receive the cap 3 therein with a certain margin.

On the other hand, when the cylinder 52 is operated, the plate-shaped member 53 and the centering member 54 mounted thereon are lifted by a given stroke relative to the movable frame 36. In the present embodiment, subsequent to the attachment of the cap 3 to the vessel 2, the cylinder 52 is initially operated to lift the centering member 54 before the capping member 44 is lifted.

It will be understood from the foregoing description that the processing head 31 which is mounted on the robot 6 comprises the movable frame 36 and the four capping mechanisms 39 mounted thereon.

A sensor 51 which detects the presence or absence of the vessel 2 is provided along the conveying path of the conveyor 4 at a point slightly upstream of the robot 6 (FIG. 2), and provides a vessel detection signal which is input to a controller associated with the robot 6. In response to the vessel detection signal from the sensor 51, the controller of the robot 6 causes the processing head 31 to move across the feeder means 5 and the conveyor 4 and to move the processing head 31 back and forth along the conveying direction over the conveyor 4.

Operation

In the described arrangement, when vessels 2 are continuously conveyed by the conveyor 4, the presence of the vessel or vessels 2 are detected by the sensor 51 shown in FIG. 2, and the detection signal is transmitted to the controller associated with the robot 6. By this time, the picker 16 of the feeder means 5 stays at rest at its downstream position while containing caps 3 in its engaging recesses 16*a*.

In response to the signal transmitted from the sensor 51, the controller associated with the robot 6 causes the processing head 31 to move to a position over the picker 16 of the feeder means 5 (FIG. 4). As a consequence, the capping mechanisms 39 which are mounted on the processing head 31 are located above the engaging recesses 16*a* in the picker 16, and the respective centering members 54 disposed below the corresponding capping mechanisms 39 are located above and adjacent to the respective caps 3. At this time, each centering member 54 is lifted to its upper end position with respect to the capping member 44 in its normal condition by means of the cylinder 52, whereby the lower end of the capping member 44 of the capping mechanism 39 projects slightly below the lower end face of the centering member 54. Since the negative pressure is applied to the capping member 44 of the capping mechanism 39, the cap 3 is held attracted by the lower end of the capping member 44.

Subsequently, the controller associated with the robot 6 causes the processing head 31 to move to a position above the conveyor 4 where it is maintained at a given elevation. In addition, each centering member 54 is caused to descend to its lower end position with respect to the capping member 44 in its normal condition. The cap 3 is then contained within the centering member 54 to be centered as shown in FIG. 10, and the capping mechanisms 39 and the centering members 54 on the processing head 31 are located directly above the four vessels 2 which are being conveyed by the conveyor 4.

The processing head 31 is moved by the motor 41 along the guide rails 35 in the direction of conveyance of the conveyor 4 with the same speed as the speed of the conveyor 4 while the entire processing head 31 is lowered through a given stroke. This allows the capping mechanism 39 and the centering member 54 to move in tracking relationship with the movement of the vessels 2. In the course of such movement, the centering member 54 is initially fitted around a mouth at the upper end of the vessel 2, whereby the center of the cap held attracted by the capping mechanism 39 is aligned with the center of the vessel 2. Since the capping mechanism 39 is also lowered, the cap 3 which is held attracted to the lower end of the capping member 44 is pressed against the vessel 2, thus attaching the cap 3 around the mouth at the upper end of vessel 2. It will be seen that the cap 3 can be attached around the mouth at the upper end of vessel 2 with a proper pressure since the coiled spring 46 of the capping mechanism 39 is compressed to allow the capping member 44 to be lifted relative to the pipe 43. As shown in FIG. 8, since the centering member 54 is capable of being lifted relative to the plate-shield member 53 through a distance by which the pins 56 can be elevated within the through-holes 53*b* to provide a relief, any damage of the upper end of vessel 2 by the abutment of the mouth against the inner periphery of the centering member 54 can be prevented when the centering member 54 is fitted around the mouth at the upper end of the vessel 2.

Subsequently, while the lower end of the capping member 44 is maintained in abutment against the upper end of the cap 3, the cylinder 52 operates to lift the centering member 54 through a given stroke. This allows the centering member 54 to be lifted relative to the lower end of the capping member 44 and the upper ends of the cap 3 and the vessel 2, whereby the centering member 54 is withdrawn from the cap 3 and the upper end of vessel 2 to be located above them. The entire processing head 31 is then lifted through a given stroke, whereby the lower end of the capping member 44 is removed from the upper end of the cap 3, thus completing the attachment of the caps 3 to four vessels 2. It is to be noted that up to this time, the processing head 31 moves in tracking relationship with the movement of the vessels 2 on the conveyor 4.

The motor 41 is then operated to return the processing head 31 to its original position by moving it in the opposite direction from the direction of conveyance of the vessels 2, and at the same time, the processing head 31 is moved from a position over the conveyor 4 to a position over the feeder means 5. During such movement, the centering member 54 is lifted to its upper end position relative to the capping member 44, and the lower end face of the centering member 54 and the lower end of the capping member 44 assume an equal elevation.

Subsequently, the processing head 31 of the robot 6 repeats the described operation to attach the caps 3 to a next set of four vessels 2 being continuously conveyed on the conveyor 4.

With the present embodiment described above, there can be provided a capping apparatus 1 which excels the prior art in its processing capability while suppressing a complicatedness in construction around the conveyor 4.

In the described embodiment, after the capping mechanism 39 has attached the cap 3 to the vessel 2, the centering member 54 is initially lifted above the cap 3 and the upper end of the vessel 2 before the capping member 44 of the capping mechanism 39 is lifted to move it away from the cap 3. This arrangement of the present embodiment allows a hanged condition of the entire vessel 2 which may result from the upper end of the vessel 2 being caught by the inner periphery of the centering member 54 to be prevented in a favorable manner.

Second Embodiment

Figure 11:
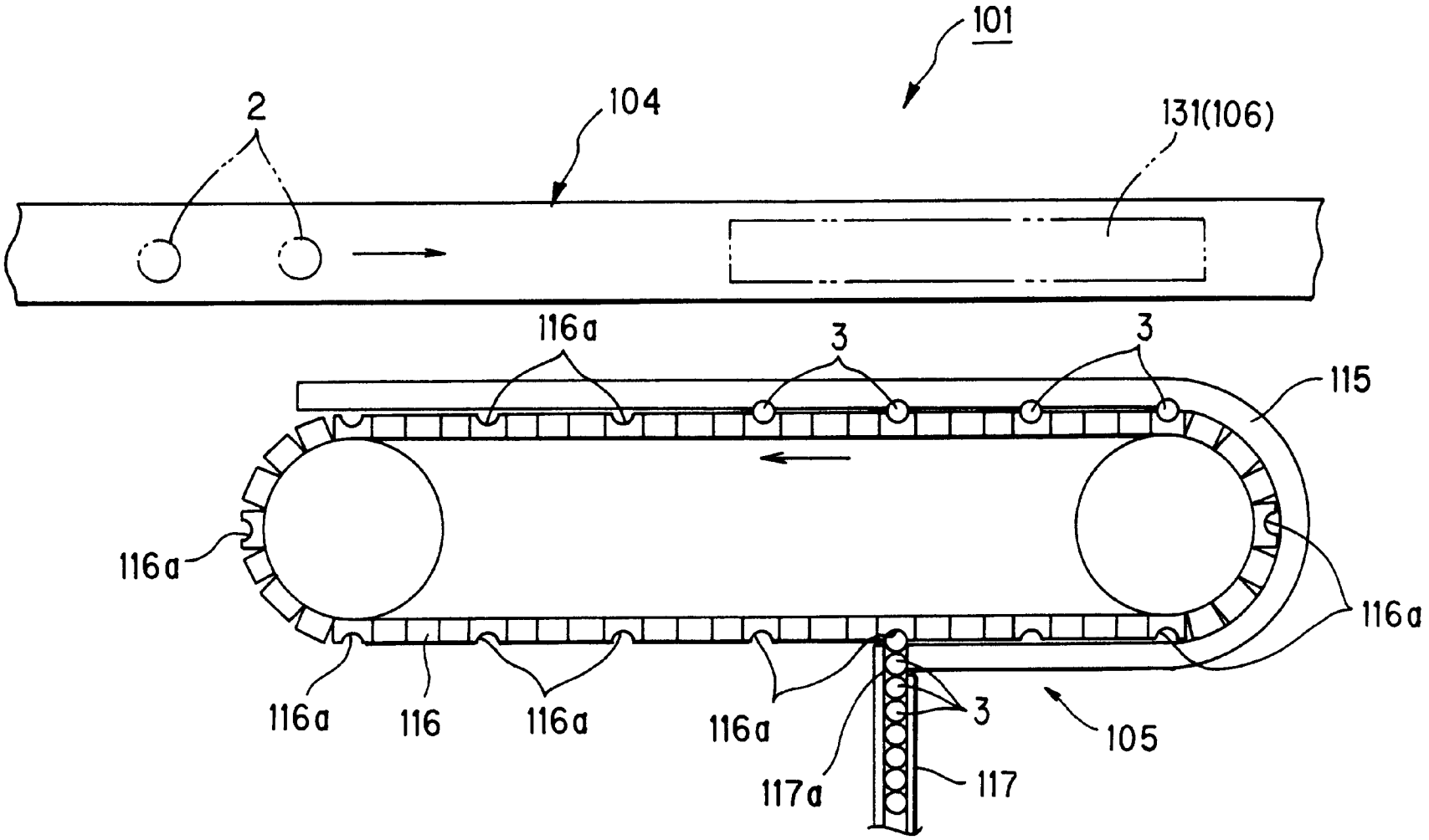
FIG. 11 is a plan view of a pertinent portion of another embodiment of the invention.

FIG. 11 shows feeder means 105 according to another embodiment. In this embodiment, feeder means 105 comprises an endless belt 116 extending parallel to the lengthwise direction of a conveyor 104 and running in circulation in a horizontal plane, a guide member 115 disposed in a given region adjacent to and outside of the endless belt 116 and a feeder chute 117 disposed at one end of the guide member 115 and in proximity to the endless belt 116.

The endless belt 116 is formed with engaging recesses 116*a* at an equal interval, and as the endless belt 116 runs in circulation in a direction indicated by an arrow, the en gaging recesses 116*a* are effective to take successive caps from the forward end 117*a* of the feeder chute 117.

In this embodiment, a robot 106 includes a processing head 131 which is located above the running endless belt 116 and holds the caps 3 attracted in the four engaging recesses 116 while tracking it during the time it returns to its original position located to the left.

In this manner, a capping apparatus which has its processing capability further enhanced can be provided. It is to be noted that in the second embodiment, members corresponding to those shown in the first embodiment are designated by corresponding reference numerals, to which 100 is added.

Third Embodiment

Figure 12:
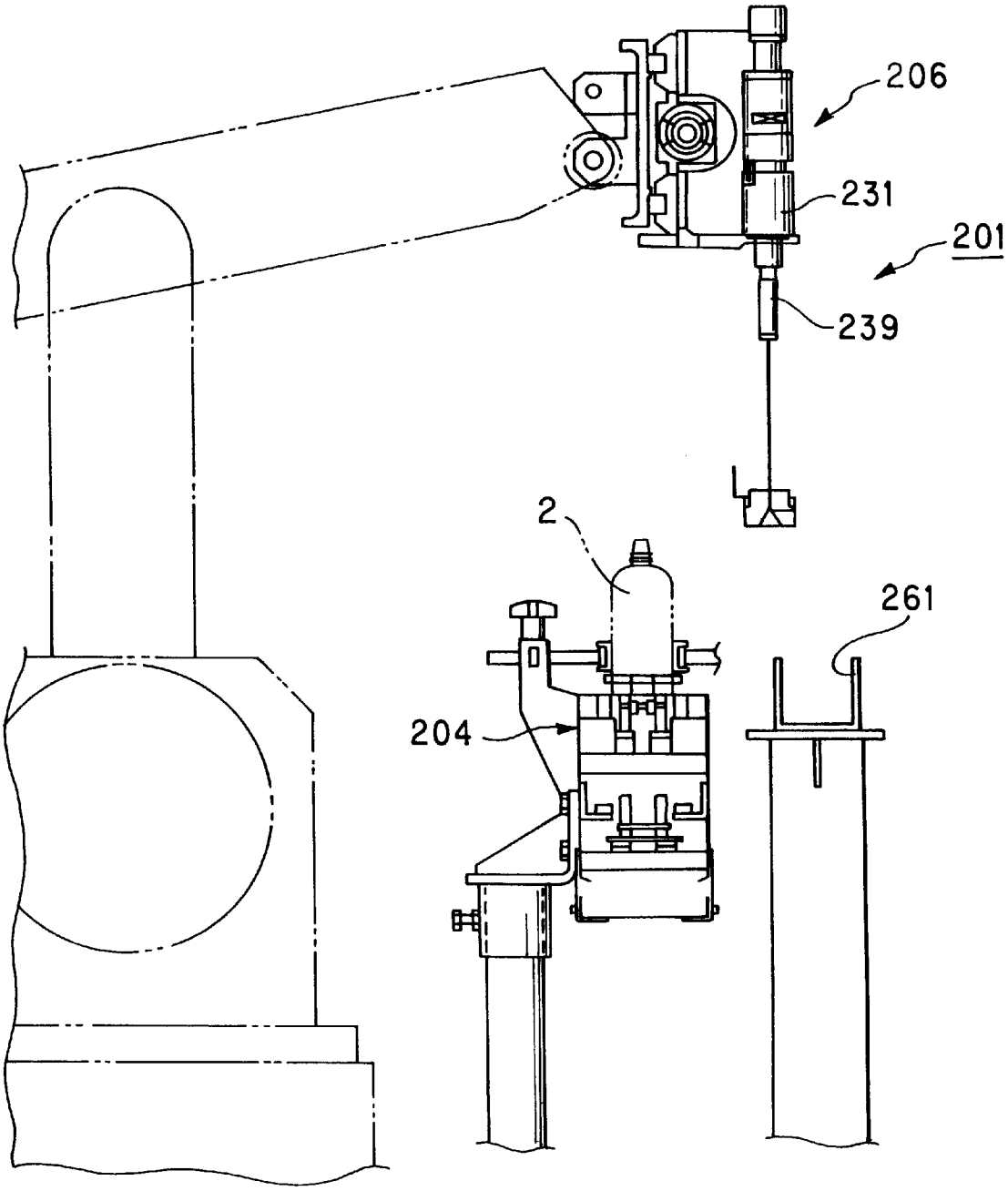
FIG. 12 is a front view of a further embodiment of the invention.

FIG. 12 shows the application of the invention to a filling apparatus 201. Specifically, a robot 206 includes a processing head 231 which is provided with four filling valves 239, each of which serves filling a vessel 2 with a liquid to be filled, instead of the capping mechanisms used in the described embodiments. The vessels 2 are filled with the liquid to be filled while moving the filling valves 239 in tracking relationship with four vessels 2 which are being conveyed by a conveyor 204.

In this embodiment, cleaning liquid recovery means 261 is disposed on the opposite side of the conveyor 204 from the robot 206. The recovery means 261 comprises a rectilinear trough, which extends parallel to the conveyor 204, but at an elevation which is slightly below the conveyor 204.

When cleaning the four filling valves 239 which are mounted on the processing head 231, the four filling valves 239 are located directly above the recovery means 261, and a cleaning liquid is allowed to flow through the filling valves 239, thus cleaning the four filling valves 239. After the cleaning operation, the cleaning liquid which flows out of four filling valves 239 drops into the recovery means 261 to be recovered within the recovery means 261.

The filling apparatus 201 shown in FIG. 12 is also capable of filling the vessels 2 with the liquid to be filled by means of the filling valves 239 while they move in tracking relationship with the movement of the vessels 2, thus providing a filling apparatus which has its processing capability enhanced as compared with the prior art. It is to be noted that in the third embodiment, members corresponding to those shown in the first embodiment are designated by like reference numerals as used before, to which 200 is added.

Fourth Embodiment

Figure 13:
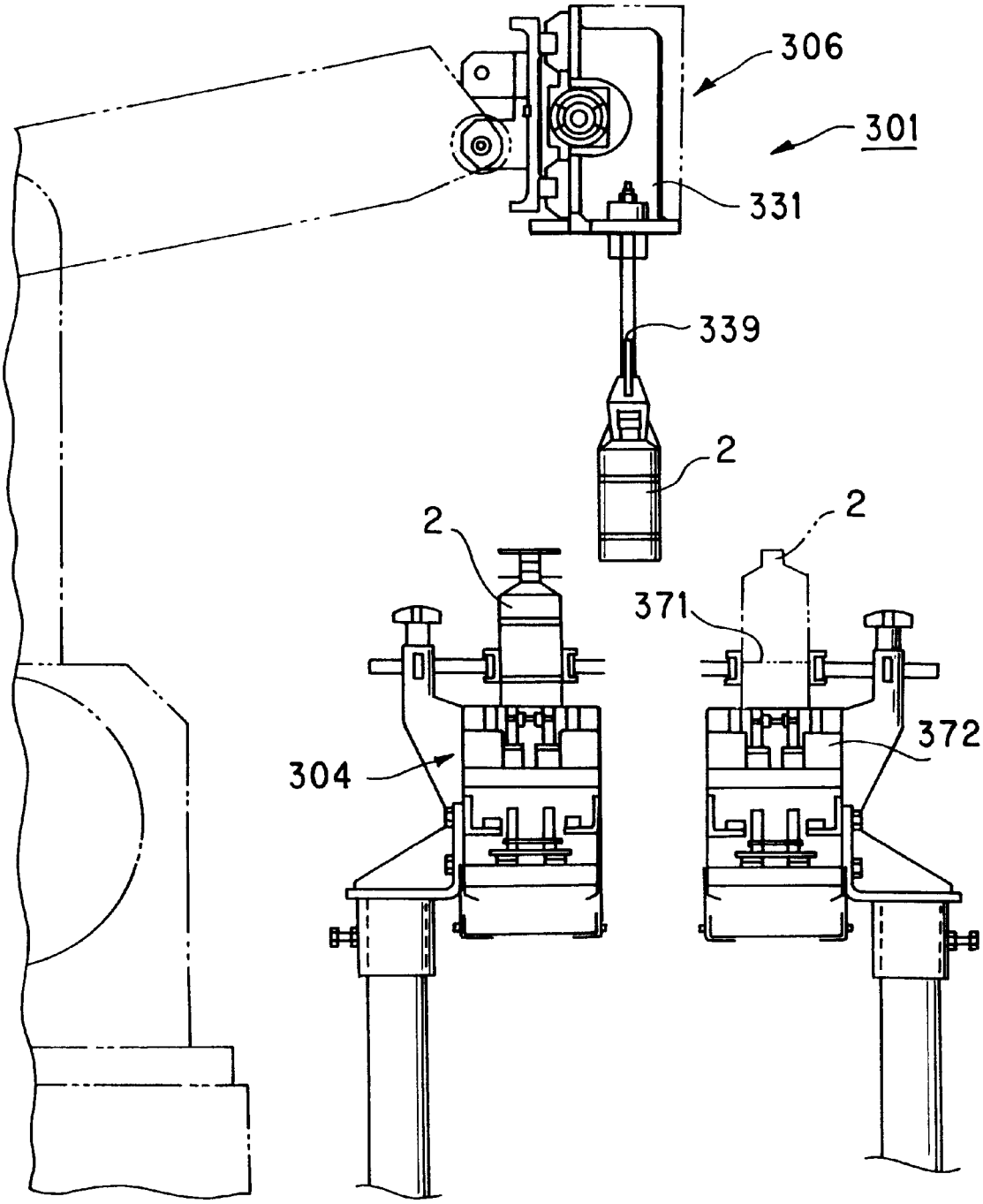
FIG. 13 is a front view of still another embodiment of the invention.

FIG. 13 illustrates the application of the invention to a processing apparatus 301 which operates to withdraw a vessel 2 from a cup-shaped skirt.

Specifically, in this embodiment, vessels 2 are conveyed by a conveyor 304, and a skirt conveyor 372 which conveys both the vessels 2 and the cup-shaped skirts 371 The skirt conveyor 372 extends parallel to the conveyor 304. The skirt conveyor 372 runs in the same direction and with the same speed as the conveyor 304.

In this embodiment, a processing head 331 is provided with four chucks 339 which hold the upper end of vessels 2, instead of the capping mechanisms.

In this embodiment, the processing head 331 is driven for movement in tracking relationship with skirts 371 which are being conveyed by the skirt conveyor 372 to operate the four chucks 339 to grasp the mouth (at the upper end) of the vessel 2 within the skirt 371, followed by a lifting operation which withdraws the vessel 2 from within the skirt 371. Subsequently, the processing head 331 which carries the vessels 2 may be positioned above the conveyor 304 and the chuck 339 may be released, whereupon the four vessels 2 are placed on the conveyor 304. In the fourth embodiment, members corresponding to those shown in the first embodiment are designated by like reference numerals as used before, to which 300 is added.

While the invention is applied to the processing apparatus 301 which withdraws a vessel 2 from a skirt 371 in FIG. 13, it will be appreciated that the invention is also applicable to an apparatus which inserts a vessel into an empty skirt being conveyed on a skirt conveyor.

While the invention has been described above in connection with several embodiments thereof it should be understood that a number of changes, modifications and substitutions therein are possible from the above disclosure without departing from the spirit and the scope of the invention defined by the appended claims.

What is claimed is:

1. An article processing apparatus comprising:

a conveyance mechanism adapted to continuously convey an article in a horizontal direction of conveyance;

a processing head movable in the direction of conveyance and including a plurality of article processing mechanisms;

a support member movably supporting the processing head;

means defining a robot for (1) moving the processing head and the support member in a direction substantially orthogonal to the direction of conveyance and (2) moving the processing head and the support member in a vertical direction by a predetermined distance and (3) moving the processing head between a first processing position above the conveyance mechanism and a second processing position deviated from the first processing position;

means defining a head moving mechanism for horizontally moving the processing head at the first processing position relative to the support member in the direction of conveyance and thus enabling the processing mechanisms of the processing head to follow the movement of articles on the conveyance mechanism.

2. An article processing apparatus according to claim 1, capable of processing articles in the form of vessels, cap feeder means for feeding a cap to the second processing position, the processing mechanisms comprising means defining capping mechanisms each for (1) taking hold of a cap at the second processing position and (2) mounting a respective cap on a vessel on the conveyance mechanism at the first processing position.

3. An article processing apparatus according to claim 2, in which the cap feeder means comprises an endless belt adapted to run in circulation in the direction of conveyance, a cap holder on the endless belt adapted to hold a cap at a predetermined position in a length direction of the endless belt, and each of the capping mechanisms being adapted to receive a second cap from the holder after completing the attachment of a first cap on a vessel being conveyed by the conveyance mechanism.

4. An article processing apparatus according to claim 1, capable of processing articles in the form of cup shaped holders and vessels accommodated therein, in which the processing mechanisms comprise chucks each for detachably holding one vessel and the chucks each are capable of taking a vessel from within a holder conveyed by the conveyance mechanism and for placing a respective vessel over to the second processing position.

5. An article processing apparatus according to claim 1, capable of processing articles in the form of vessels in cup-shaped holders, wherein the processing mechanisms are chucks each capable of detachably holding a vessel, the chucks each capable of taking a vessel in the second processing position and inserting a respective vessel into a cup-shaped holder being conveyed by the conveyance mechanism.

6. An article processing apparatus according to claim 2, in which the processing mechanisms include centering members each located below one of the capping mechanisms and means defining a lift mechanism for vertically moving the centering members and means defining plugging mechanisms for attaching caps to vessels, each centering member having means for effecting alignment of the center of a cap held by a respective one of the capping mechanisms and the center of a respective vessel for attachment of a respective cap, a corresponding plugging mechanism for attaching a respective cap to an upper end mouth of a respective vessel.

7. An article processing apparatus according to claim 6, in which the conveyance mechanism is adapted to convey a train of vessels, and each of the centering members, movable by the lift mechanism, is capable of abutment with an upper end mouth of a vessel.

8. An article processing apparatus comprising:

means defining a conveyance mechanism for continuously conveying an article in a horizontal direction of conveyance;

a robot adjacent said conveyance mechanism and comprising a plurality of rocking arms, one of said rocking arms including an end face maintained in a vertical plane parallel to said direction of conveyance of said conveyance mechanism;

means including a motor for causing the robot to move said end face of said one rocking arm (1) in a direction substantially orthogonal to said direction of conveyance and (2) in a vertical direction for a predetermined distance;

a processing head secured to said end face of said one rocking arm;

means defining a head moving mechanism for horizontally moving said processing head relative to said end face in said direction of conveyance; and a plurality of processing mechanisms secured to said processing head and having means for processing articles on said conveyance mechanism.

9. An article processing apparatus according to claim 8, including a pair of guide rails mounted to said one end face of said one rocking arm and extending horizontally in parallel to said direction of conveyance.

10. An article processing apparatus according to claim 8, capable of processing articles comprising vessels, wherein said processing mechanisms comprise capping mechanisms, each said capping mechanism further comprising:

a stepped tubular capping member extending downwardly from said processing head; and a centering member disposed at the lower end of said capping member and extending downwardly therefrom.

11. An article processing apparatus according to claim 10, including a cap feeder comprising:

an endless belt extending parallel to the direction of conveyance of said conveyance mechanism in a horizontal plane;

means defining a feeder chute for receiving caps from said endless belt; and means defining a picker for receiving caps from said feeder chute.

12. The article processing apparatus according to claim 8, capable of processing articles in the form of vessels, wherein said processing mechanisms each comprise a filling valve capable of filling a vessel, said processing apparatus further comprising a cleaning liquid recovery means for receiving cleaning fluid periodically flowing through said filling valves.

13. The article processing apparatus according to claim 12, wherein said cleaning liquid recovery means comprises a rectilinear trough which extends parallel to said conveyance mechanism.

14. The article processing apparatus according to claim 8, capable of processing articles in the form of vessels, said processing apparatus including a skirt conveyor operable at the same speed as, and extending parallel to said conveyance mechanism, said skirt conveyor carrying cup-shaped skirts.

15. An article processing apparatus according to claim 14, wherein said processing mechanisms comprise chucks for holding upper ends of vessels and for withdrawing vessels from said skirt conveyor and for placing vessels on said conveyance mechanism.

16. An vessel processing apparatus comprising means defining a conveyance mechanism for continuously conveying an article in a horizontal direction of conveyance, and processing means adjacent the conveyance mechanism, the processing means including a support member which is (1) elevatable and (2) movable in a direction orthogonal to the direction of conveyance, and a processing head mounted on the support member and movable along the direction of conveyance relative to the support member and movable with the support member between a first processing position disposed above the conveyance mechanism and a second processing position which is offset from the first processing position, in which the processing means comprises a robot carrying the support member and operable for moving the support member, the processing head being provided with a filing valve which fills a vessel with a liquid, recovery means disposed at the second processing position for recovering a cleaning liquid which is useable to clean the filling valve, the processing head being arranged to fill a vessel in combination with its said movement in the conveyance direction, the processing head in the second processing position being located above the recovery means such that the filling valve is cleanable by the cleaning liquid, and the cleaning liquid is recoverable by the recovery means.

* * * * *